US007042981B2

(12) United States Patent
Subraya et al.

(10) Patent No.: US 7,042,981 B2
(45) **Date of Patent: *May 9, 2006**

(54) X-RAY TUBE WINDOW AND SURROUNDING ENCLOSURE COOLING APPARATUSES

(75) Inventors: Madhusudhana T. Subraya, New Berlin, WI (US); Carey S. Rogers, Waukesha, WI (US); Manohar G. Kollegal, Bangalore (IN); Doug Snyder, Carmel, IN (US); Krystyna Truszkowska, Niskayuna, NY (US)

(73) Assignee: General Electric Co., Schnectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/707,369

(22) Filed: Dec. 9, 2003

(65) Prior Publication Data

US 2004/0223588 A1 Nov. 11, 2004

Related U.S. Application Data

(63) Continuation-in-part of application No. 10/065,392, filed on Oct. 11, 2002, now Pat. No. 6,714,626.

(51) Int. Cl.
*H01J 35/18* (2006.01)

(52) U.S. Cl. ..... 378/140; 378/141

(58) Field of Classification Search ..... 378/140, 378/141, 130
See application file for complete search history.

(56) References Cited

U.S. PATENT DOCUMENTS

| | | | | |
|---|---|---|---|---|
| 6,142,222 | A * | 11/2000 | Kang et al. | 165/148 |
| 6,185,279 | B1 * | 2/2001 | Chambron | 378/161 |
| 6,215,852 | B1 * | 4/2001 | Rogers et al. | 378/142 |
| 6,263,046 | B1 * | 7/2001 | Rogers | 378/141 |
| 6,301,332 | B1 * | 10/2001 | Rogers et al. | 378/142 |
| 6,390,187 | B1 * | 5/2002 | Marechal et al. | 165/172 |
| 6,430,263 | B1 * | 8/2002 | Lu et al. | 378/140 |
| 6,438,208 | B1 * | 8/2002 | Koller | 378/140 |
| 6,714,626 | B1 * | 3/2004 | Subraya et al. | 378/141 |

* cited by examiner

*Primary Examiner*—David V. Bruce
*Assistant Examiner*—Hoon Song
(74) *Attorney, Agent, or Firm*—Peter J. Vogel

(57) ABSTRACT

An x-ray tube window cooling assembly (11) for an x-ray tube (18) includes an electron collector body (110). The electron collector body (110) is thermally coupled to an x-ray tube window (102). The electron collector body (110) may include a coolant circuit (112) with a coolant inlet (114) and a coolant outlet (122). One or more thermal exchange devices may be coupled to the x-ray tube window (102) or to the coolant circuit (112) and reduce temperature of the x-ray tube window (102).

26 Claims, 9 Drawing Sheets

X-RAY TUBE WINDOW AND SURROUNDING ENCLOSURE COOLING APPARATUSES

The present application is a Continuation-In-Part (CIP) application of U.S. patent application Ser. No. 10/065,392 filed on Oct. 11, 2002, now U.S. Pat. No. 6,714,626 entitled "JET COOLED X-RAY TUBE WINDOW", which is incorporated by reference herein.

BACKGROUND OF THE INVENTION

The present invention relates generally to thermal energy management systems within electron beam generating devices. More particularly, the present invention relates to an assembly for cooling an x-ray tube window.

There is a continuous effort to increase scanning capabilities of x-ray imaging systems. This is especially true in computed tomography (CT) imaging systems. Customers desire the ability to perform longer scans at increased power levels. The increase in scan times at higher power levels allows physicians to gather CT images and constructions in a matter of seconds rather than in a matter of several minutes as with previous CT imaging systems. Although the increase in imaging speed provides improved imaging capability, the increase causes new constraints and requirements for the functionality of the CT imaging systems.

A CT imaging system typically includes a gantry that rotates at various speeds in order to create a 360° image. The gantry contains an x-ray tube, which composes a large portion of the rotating gantry mass. The CT tube generates x-rays across a vacuum gap between a cathode and an anode. In order to generate the x-rays, a large voltage potential is created across the vacuum gap, which allows electrons to be emitted, in the form of an electron beam. The electron beam is emitted from the cathode to a target on the anode. In releasing of the electrons, a filament contained within the cathode is heated to incandescence by passing an electric current therein. The electrons are accelerated by the high voltage potential and impinge on the target, where they are abruptly slowed down to emit x-rays. The high voltage potential produces a large amount of heat within the CT tube, especially within the anode.

The high voltage potential leads to high heat fluxes in the vicinity of the x-ray tube window, which is especially true in low glancing angle electron beam type systems. The high heat fluxes are due to back-scattered electrons that are deposited on the CT tube vacuum housing or vessel in the vicinity of a radiation exit window, in line with the forward direction of the primary electron beam.

The vacuum vessel is typically enclosed in a casing filled with circulating cooling fluid, such as dielectric oil. The cooling fluid often performs two duties: cooling the vacuum vessel, and providing high voltage insulation between the anode and the cathode. High temperatures at an interface between the vacuum vessel and a transmissive window in the casing cause the cooling fluid to boil, which may degrade the performance of the cooling fluid. Bubbles may form within the fluid and cause high voltage arcing across the fluid. The arcing degrades the insulating ability of the fluid. The bubbles can cause image artifacts that can result in low quality images.

Typically, a small portion of energy within the electron beam is converted into x-rays; the remaining electron beam energy is converted into thermal energy within the anode. Due to the inherent poor efficiency of x-ray production and the desire for increased x-ray flux, heat load is increased that must be dissipated. The thermal energy is radiated to other components within a vacuum vessel of the x-ray tube. Some of the thermal energy is removed from the vacuum vessel via the cooling fluid. Approximately 40% of the electrons within the electron beam are back-scattered from the anode and impinge on other components within the vacuum vessel, causing additional heating of the x-ray tube. As a result, the x-ray tube components are subjected to high thermal stresses that decrease component life and reliability of the x-ray tube.

Prior cooling methods have primarily relied on quickly dissipating thermal energy by circulating coolant within structures contained in the vacuum vessel. The coolant fluid is often a special fluid for use within the vacuum vessel, as opposed to the cooling fluid that circulates about the external surface of the vacuum vessel.

As power of the x-ray tubes continues to increase, heat transfer rate to the coolant can exceed heat flux absorbing capabilities of the coolant. Other methods have been proposed to electromagnetically deflect the back-scattered electrons so that they do not impinge on the x-ray window. These approaches, however, do not provide for significant levels of energy storage and dissipation.

A thermal energy storage device or electron collector, coupled to an x-ray window, has been used to collect back-scattered electrons between the cathode and the anode. The electron collector is typically implemented in monopolar x-ray tubes. The x-ray window is typically formed of a material having a low atomic number, such as beryllium. A significant amount of heat is generated from the impact of the back-scattered electrons on the electron collector and X-ray window, due to retention of a significant amount of kinetic energy in the back-scattered electrons.

In using the electron collector, the collector and window need to be properly cooled to prevent high temperature and thermal stresses, which can damage the window and joints between the window and collector. High temperature surfaces of the window and collector can induce boiling of the coolant. Bubbles generated from the boiling coolant can obscure the window and thereby compromise image quality. Extensive boiling of the coolant results in chemical breakdown of the coolant and the formation of sludge on the window, which also results in poor image quality.

Thus, there exists a need for an improved apparatus and method of cooling an x-ray tube window that allows for increased scanning speed and power, is relatively easy to manufacture, and minimizes blurring and artifacts in a reconstructed image.

SUMMARY OF INVENTION

The present invention provides an x-ray tube window cooling assembly for an x-ray tube that includes an electron collector body. The electron collector body is thermally coupled to an x-ray tube window. The electron collector body may include a coolant circuit with a coolant inlet and a coolant outlet. One or more thermal exchange devices may be coupled to the x-ray tube window or to the coolant circuit and reduce temperature of the x-ray tube window.

The embodiments of the present invention provide several advantages. One such advantage that is provided by multiple embodiments of the present invention is the provision of a cooling mechanism located within the electron collector and formed of a porous material, which effectively removes thermal energy from the coolant. The porous material absorbs a substantial amount of thermal energy generated from back-scattered electrons.

Another advantage that is provided by an embodiment of the present invention is the provision of curved thermal exchange devices, which enhances nucleate bubble migration away from the collector body and increases power dissipation.

Yet another advantage provided by an embodiment of the present invention is the provision of a heat receptor coupled to the electron collector body further absorbing a substantial amount of thermal energy generated from the back-scattered electrons.

Furthermore, another advantage provided by an embodiment of the present invention is the provision of a combination of multiple coolant channels and a thermal exchange cavity containing a porous material or phase change material. This embodiment also aids in absorbing thermal energy generated from the back-scattered electrons.

Moreover, another embodiment of the present invention provides a thermal exchange device with a substantially large surface area that is configured to correspond with angular orientation and surface area of a target.

The present invention itself, together with attendant advantages, will be best understood by reference to the following detailed description, taken in conjunction with the accompanying figures.

BRIEF DESCRIPTION OF DRAWINGS

For a more complete understanding of this invention reference should now be had to the embodiments illustrated in greater detail in the accompanying figures and described below by way of examples of the invention wherein.

DETAILED DESCRIPTION

While the present invention is described with respect to an assembly for cooling an x-ray tube window within a computed tomography (CT) imaging system, the following apparatus and method is capable of being adapted for various purposes and is not limited to the following applications: MRI systems, CT systems, radiotherapy systems, flouroscopy systems, X-ray imaging systems, ultrasound systems, vascular imaging systems, nuclear imaging systems, magnetic resonance spectroscopy systems, and other applications known in the art.

In the following description, various operating parameters and components are described for one constructed embodiment. These specific parameters and components are included as examples and are not meant to be limiting.

Also, in the following description the term "impinge" refers to an object colliding directly with another object. For example, as known in the art, an electron beam impinges upon a target of an anode within an x-ray tube. The electron beam is directed at the target such that electrons within the beam collide with the target. Similarly, a coolant may be directed at a surface as to collide with the surface. The coolant in being directed at a surface may be reflected from another surface. The term "impinge" does not refer to an object simply coming into contact with another object, such as coolant flowing over a surface of an object.

Additionally, the term "thermal exchange device" may refer to a thermal receptor, porous body, a porous element, a channel, a pocket, a fin pocket, a cooling fin or other thermal exchange device known in the art. More than one thermal exchange device may exist in an electron collector body. For example, a coolant channel may have a porous body contained therein. Coolant may pass through the porous body when passing through the coolant channel. The coolant channel and the porous body are both considered thermal exchange devices.

Figure 1:
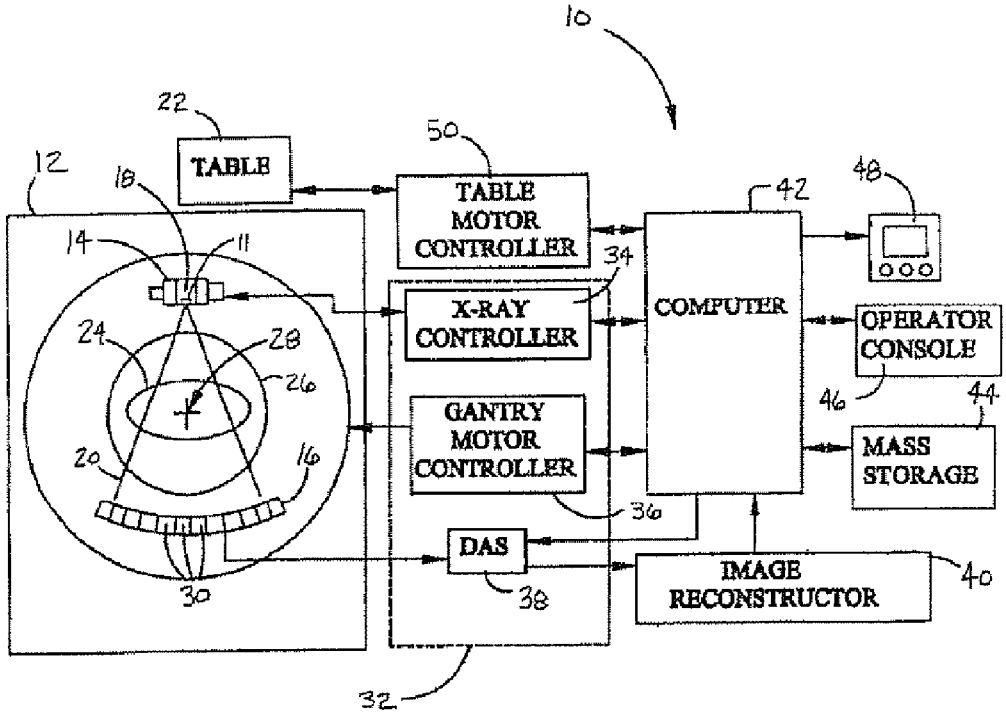
FIG. 1 is a schematic block diagrammatic view of a multi-slice CT imaging system utilizing an x-ray tube window cooling assembly in accordance with an embodiment of the present invention.

Referring now to FIG. 1, a schematic block diagrammatic view of a multi-slice CT imaging system 10 utilizing an x-ray tube window cooling assembly 11 in accordance with an embodiment of the present invention is shown. The imaging system 10 includes a gantry 12 that has an x-ray tube assembly 14 and a detector array 16. The x-ray tube assembly 14 has an x-ray generating device or x-ray tube 18. The tube 18 projects a beam of x-rays 20 towards the detector array 16. The tube 18 and the detector array 16 rotate about an operably translatable table 22. The table 22 is translated along a z-axis between the assembly 14 and the detector array 16 to perform a helical scan. The beam 20 after passing through a medical patient 24, within a patient bore 26, is detected at the detector array 16. The detector array 16 upon receiving the beam 20 generates projection data that is used to create a CT image.

The tube 18 and the detector array 16 rotate about a center axis 28. The beam 20 is received by multiple detector elements 30. Each detector element 30 generates an electrical signal corresponding to the intensity of the impinging x-ray beam 20. As the beam 20 passes through the patient 24 the beam 20 is attenuated. Rotation of the gantry 12 and the operation of tube 18 are governed by a control mechanism 32. The control mechanism 32 includes an x-ray controller 34 that provides power and timing signals to the tube 18 and a gantry motor controller 36 that controls the rotational speed and position of the gantry 12. A data acquisition system (DAS) 38 samples analog data from the detector elements 30 and converts the analog data to digital signals for subsequent processing. An image reconstructor 40 receives sampled and digitized x-ray data from the DAS 38 and performs high-speed image reconstruction. A main controller or computer 42 stores the CT image in a mass storage device 44.

The computer 42 also receives commands and scanning parameters from an operator via an operator console 46. A display 48 allows the operator to observe the reconstructed image and other data from the computer 42. The operator supplied commands and parameters are used by the computer 42 in operation of the DAS 38, the x-ray controller 34, and the gantry motor controller 36. In addition, the computer 42 operates a table motor controller 50, which translates the table 22 to position patient 24 in the gantry 12.

The x-ray controller 34, the gantry motor controller 36, the image reconstructor 40, the computer 42, and the table motor controller 50 may be microprocessor-based such as a computer having a central processing unit, memory (RAM and/or ROM), and associated input and output buses. The x-ray controller 34, the gantry motor controller 36, the image reconstructor 40, the computer 42, and the table motor controller 50 may be a portion of a central control unit or may each be stand-alone components as shown.

Figure 2:
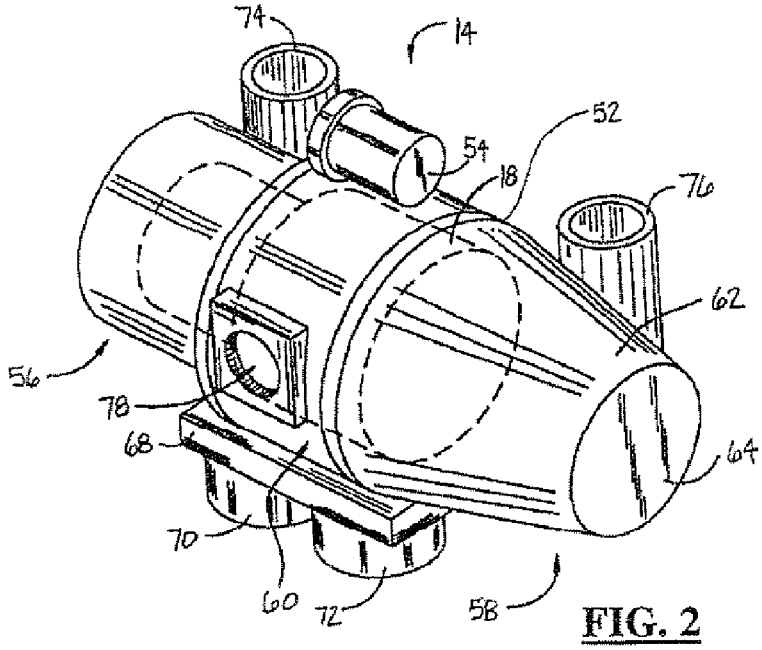
FIG. 2 is a perspective view of a x-ray tube assembly incorporating the x-ray tube window cooling assembly in accordance with an embodiment of the present invention.

Referring now to FIG. 2, a perspective view of the x-ray tube assembly 14 incorporating the cooling assembly 11 in accordance with an embodiment of the present invention is shown. The tube assembly 14 includes the x-ray tube 18, a housing unit 52 having a coolant pump 54, an anode end 56, a cathode end 58, and a center section 60. The center section 60 is positioned between the anode end 56 and the cathode end 58. The x-ray tube 18 is enclosed in a fluid chamber 62 that is within a lead-lined casing 64. The chamber 62 is typically filled with fluid, such as dielectric oil, but other fluids including water or air may be utilized. The fluid circulates through housing 52 to cool the x-ray tube 18 and may insulate the casing 64 from the high electrical charges within the x-ray tube 18. A radiator 68 is positioned to one side of the center section 60 and cools the cooling fluid 66. The radiator 68 may have fans 70 and 72 operatively connected to the radiator 68, which provide airflow over the radiator 68. The pump 54 is provided to circulate the fluid 66 through the housing 52, through the radiator 68, and through the cooling assembly 11. Electrical connections, for communication with the x-ray tube 18, are provided through an anode receptacle 74 and a cathode receptacle 76. A casing window 78 is provided for x-ray emission from the casing 64.

Figure 3:
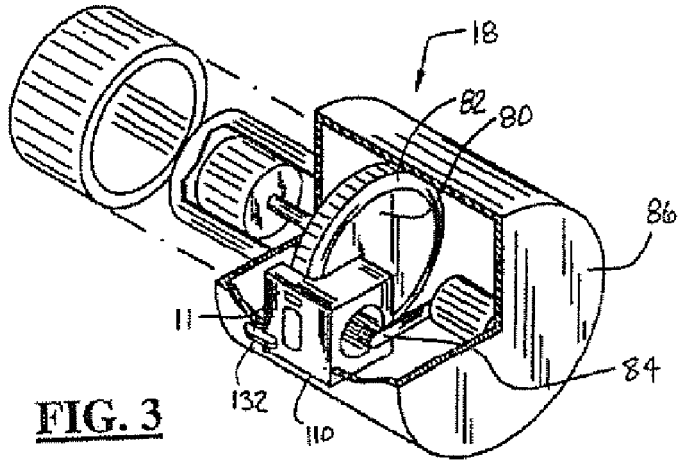
FIG. 3 is a sectional perspective view of an x-ray tube incorporating the x-ray tube window cooling assembly in accordance with an embodiment of the present invention.
Figure 4:
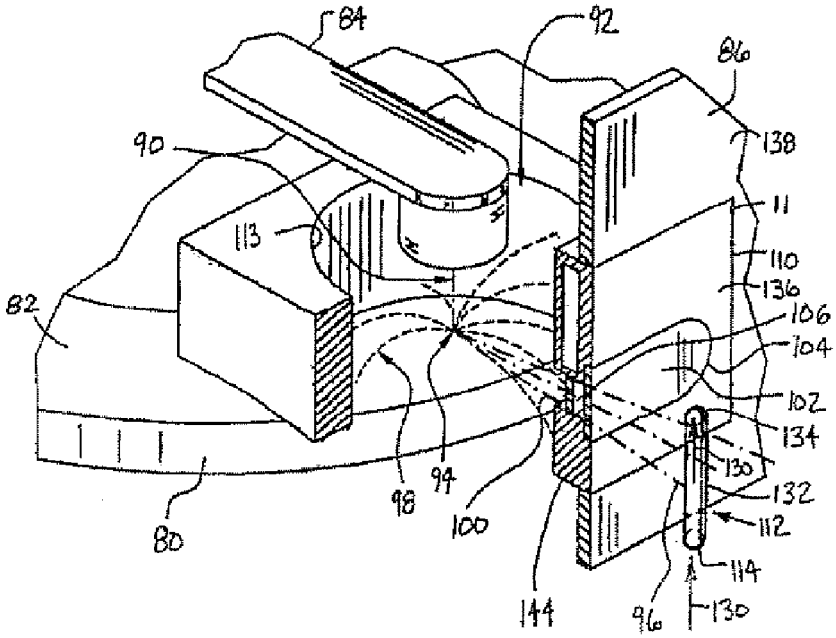
FIG. 4 is a close-up sectional perspective view of the x-ray tube incorporating the x-ray tube window cooling assembly in accordance with an embodiment of the present invention.

Referring now to FIGS. 3 and 4, sectional perspective views of the x-ray tube 18 incorporating the cooling assembly 11 in accordance with an embodiment of the present invention is shown. The x-ray tube 18 includes a rotating anode 80, having a target 82, and a cathode assembly 84. The cathode assembly 84 is disposed in a vacuum within vessel 86. The cooling assembly 11 is interposed between the anode 80 and the cathode 84.

In operation, an electron beam 90 is directed through a central cavity 92 and accelerated toward the anode 80. The electron beam 90 impinges upon a focal spot 94 on the target 82 and produces high frequency electromagnetic waves or x-rays 96 and residual energy. The residual energy is absorbed by the components within the x-ray tube 18. The x-rays 96 are directed through the vacuum toward an aperture 100 in the cooling assembly 11. The aperture 100 collimates the x-rays 96, thereby reducing the radiation dosage received by the patient 24.

The residual energy includes radiant thermal energy from anode 80 and kinetic energy of back-scattered electrons 98 that deflect off the anode 80. The kinetic energy is converted into thermal energy upon impact with the components in the vessel 86. A portion of the kinetic energy is absorbed by the cooling assembly 11 and transferred to the coolant circulating therein.

Disposed within the aperture 100 is an x-ray tube window 102, formed of a material that efficiently allows passage of the x-rays 96. The window 102 is hermetically sealed to the cool assembly 11 at a joint 104. The window 102 may be sealed through vacuum brazing or welding processes known in the art. The seal 104 serves to maintain the vacuum within the vessel 86. A filter 106 is mounted within the aperture 100 and is disposed between the anode 80 and the window 102. Similar to the window 102, the filter 106 allows the passage of the diagnostic x-rays 96.

Figure 5:
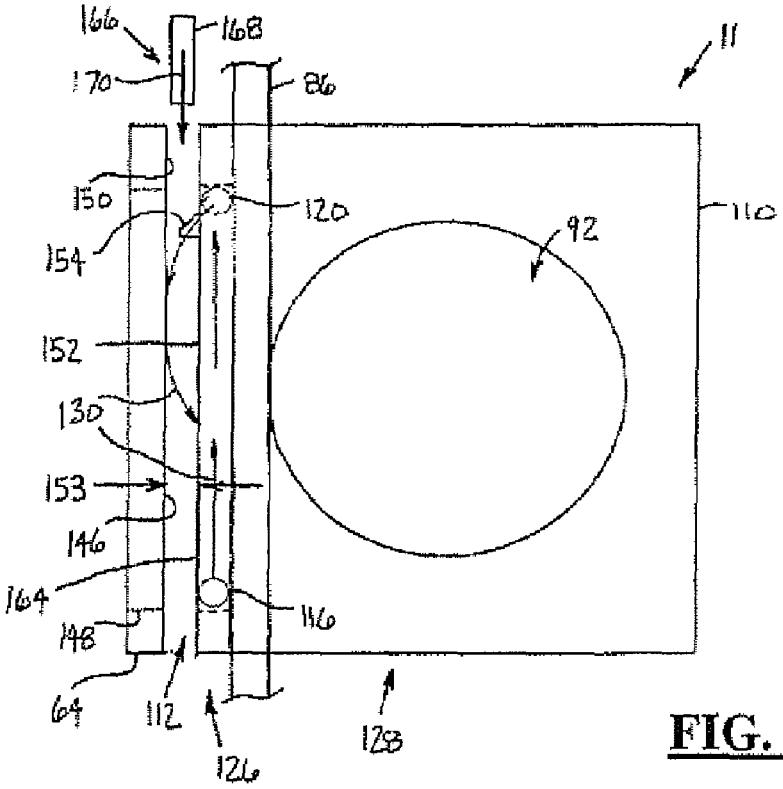
FIG. 5 is a top view of the x-ray tube window cooling assembly in accordance with an embodiment of the present invention.
Figure 6:
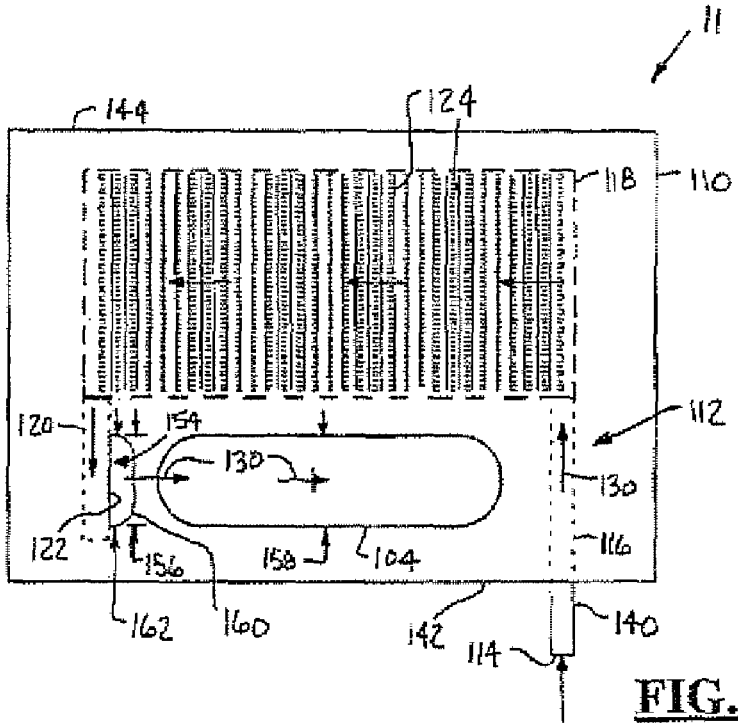
FIG. 6 is a front view of the x-ray tube window cooling assembly in accordance with an embodiment of the present invention.

Referring now to FIG. 4 and to FIGS. 5 and 6, where a front view and a side view of the cooling assembly 11 in accordance with an embodiment of the present invention are shown. The cooling assembly 11 includes an electron collector body 110 with a first coolant circuit 112. The back-scattered electrons 98 impinge upon an inner side 113 of the collector body 110. The inner side 113 surrounds the beam 90 such that a majority of the kinetic energy in the back-scattered electrons 98 is absorbed into the collector body 110. The first coolant circuit 112 includes a coolant inlet 114, a first channel 116, a fin pocket 118, a second channel 120, and a coolant outlet 122. Coolant is received through the inlet 114, through the first channel 116, is cooled by the multiple cooling fins 124 within the fin pocket 118, passes through the second channel 120, and is then directed at the window 102 by the outlet 122.

The collector 110 has a coolant side 126 and a vacuum side 128. The coolant side 126 includes the inlet 114 and the outlet 122. In one embodiment of the present invention, as illustrated by FIGS. 3 and 4, the coolant enters the first channel 116, as is represented by arrows 130. The coolant 130 enters the first channel 116 via a first external tube 132 that is coupled over an opening 134, in a collector exterior surface 136, of the collector 110. In the embodiment of FIGS. 3 and 4, the vessel exterior surface 138 is flush with the collector surface 136. In another embodiment of the present invention, as illustrated by FIGS. 4 and 5, when the collector 110 protrudes from the vessel 86 a second external tube 140 may be attached on a lower side 142 of the collector 110.

The fin pocket 118 is located within a single wall 144 of the collector 110 above the window 102. By having the fin pocket 118 only on the coolant side 126, risk of a vacuum leak is minimized since the fins 124 are not brazed to a side of the collector 110 that is on the vacuum side 128, as in prior art thermal energy storage devices. When fins are brazed into a side of a collector, seams are created, which can develop leaks over time. Incorporation of the fins 124 in a single wall 144 of the collector 110, eliminates the seams within the collector 110, on the vacuum side 128, resulting in less potential for vacuum leaks. Although the fin pocket 118 may be on multiple sides of the collector 110 and may be in multiple locations, by having the fin pocket located as stated, manufacturing simplicity is provided and efficient thermal energy transfer is maintained. Although multiple cooling fins 124 are shown as lanced offset cooling fins, other style cooling fins or high efficiency extended cooling surfaces known in the art may be used.

The outlet 122 directs coolant at a reflection surface 146 on the x-ray tube 118. The reflection surface 146 may be a portion of a transmissive device 148 of the casing 64, as shown, may be an internal casing wall surface 150, or may be some other deflection surface known in the art. The reflection surface 146 is located opposite that of an x-ray tube window surface 152, with a gap 153 therebetween. The coolant 130 passes through the fin pocket 118 and is then directed from the outlet 122 to reflect off the reflection surface 146 to impinge upon and cool the window 102. The gap 153 may be of various widths and may be adjusted such that the coolant 130 impinges appropriately on the window 102.

The outlet 122 has an opening 154 with a cross-sectional area that is smaller relative to the cross-sectional area of the fin pocket 118. The opening 154 is perpendicular to the direction of the coolant flow such that as the coolant 130 is passed from the fin pocket 118 through the outlet 122 the velocity of the coolant 130 increases. By increasing the velocity of the coolant 130, the outlet 122 in conjunction with the fin pocket 118 performs as a coolant jet, which further aids in the cooling of the window 102. Also, the outlet 122 has an opening width 156 that is approximately equal to a width 158 of the window 102. The coolant 130 impinges across the width 158 and provides uniform cooling of the window 102.

A guide 160 may be incorporated to aid in flow direction of the coolant 130. The guide 160 may also have similar width to that of the opening width 156 and width 158, as shown by designated width 162. The guide 160 may be in various forms, sizes, and styles. The guide 160 may protrude from the collector 110, as shown, or may be incorporated within the collector 110 to be flush with the collector exterior surface 164.

The transmissive device 148 is in the form of a transmissive window that allows the x-rays 96 to pass through the casing 64. The transmissive device 148 may be formed of aluminum or other material known in the art.

A second coolant circuit 166 may be incorporated within the cooling assembly 11 and include an auxiliary coolant jet 168 to direct additional coolant 170 to flow across the window surface 152, as best seen in FIG. 5. The auxiliary jet 168 directs the coolant 170 in the same direction as the flow of the coolant 130 from the outlet 122 to increase the coolant flow to and cooling of the window 102. The auxiliary jet 168 may be in various locations and have various orientations.

The cooling circuits 112 and 166 may receive the coolant 130 from the pump 54, via a separate pump, or from some other coolant source known in the art.

Figure 7:
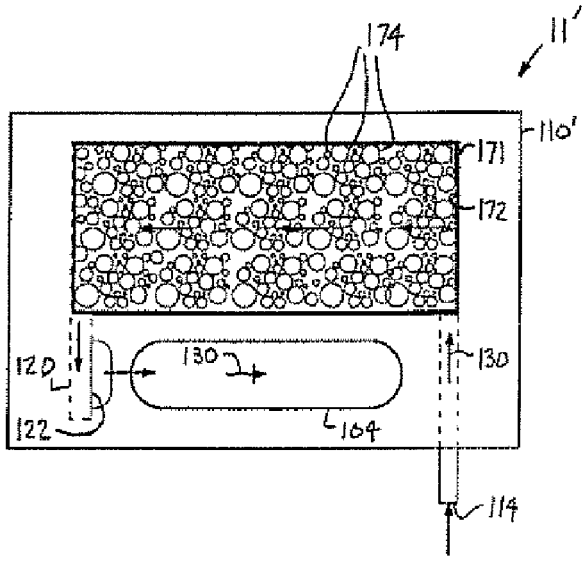
FIG. 7 is a front view of an x-ray tube window cooling assembly incorporating a porous body external to a vacuum side of an x-ray tube in accordance with another embodiment of the present invention.

Referring now to FIG. 7, a front view of an x-ray tube window cooling assembly 11' incorporating a porous body 171 external to the vacuum side 128 of the x-ray tube 118 in accordance with another embodiment of the present invention is shown. The porous body 171 is a thermal exchange device, such as a heat exchanger, and resides within a pocket 172. The porous body 171 absorbs thermal energy from the collector 110 and transfers it to the coolant 130. The porous body 171 is formed of a porous material, such as a porous metal, a porous graphitic material, some other porous material known in the art having similar properties, or some combination thereof. The porous material is represented by the circles 174. The porous body 171 has a large surface area and a high heat transfer coefficient, thereby allowing it to absorb a substantial amount of thermal energy. The porous body 171 may be formed as an integral part of the collector 110' or be separate from the collector 110' and reside within the pocket 172, as shown.

Figure 8:
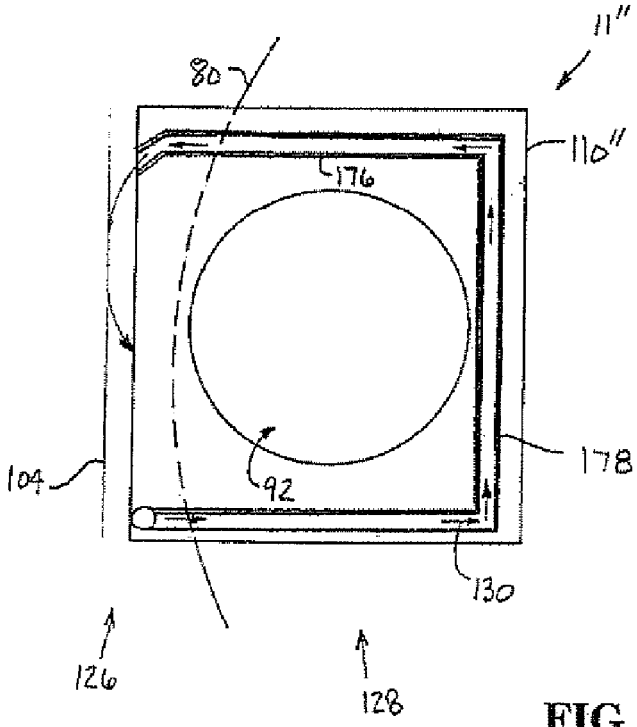
FIG. 8 is a top view of an x-ray tube window cooling assembly incorporating a porous body on a vacuum side of an x-ray tube in accordance with another embodiment of the present invention.

Referring now to FIG. 8, a top view of an x-ray tube window cooling assembly 11" incorporating a porous body 176 on a vacuum side 128 of the x-ray tube 18 in accordance with another embodiment of the present invention is shown. The porous body 176 resides within a coolant channel 178 of the electron collector 110". The porous body 176 may be formed integrally with the collector body 110" or may reside within the channel 178, as shown. As with the porous body 171, the porous body 176 is formed of one or more porous materials, such as those stated above.

The porous bodies 171 and 176 of FIGS. 7 and 8 may be of various size and shape and may be located in various locations in the collector bodies 110' and 110". The collector bodies 110' and 110", themselves, may also be formed of one or more porous materials.

Figure 9:
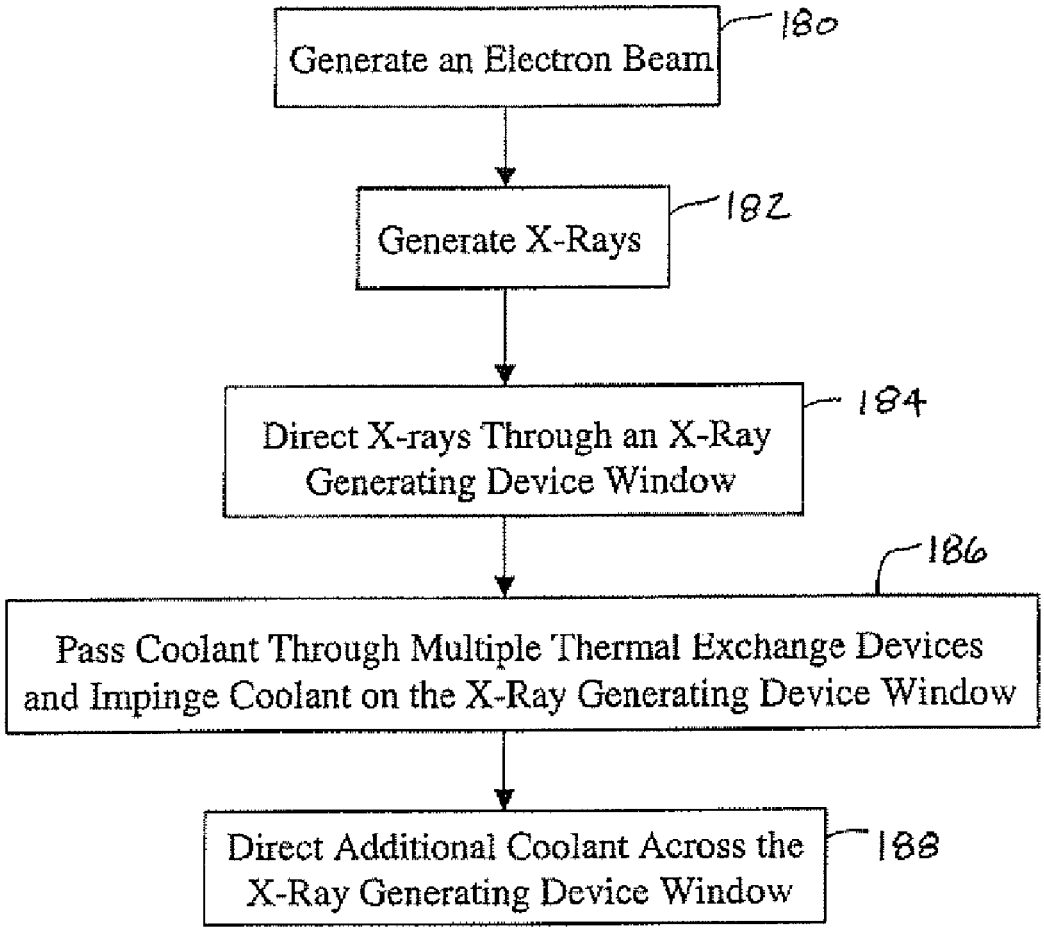
FIG. 9 is a logic flow diagram illustrating a method of operating an x-ray generating device x-ray tube window cooling assembly in accordance with an embodiment of the present invention.

Referring now to FIG. 9, a logic flow diagram illustrating a method of operating the x-ray tube 18 in accordance with an embodiment of the present invention is shown.

In step 180, the electron beam 90 is generated as stated above.

In step 182, the electron beam 90 is directed to impinge upon the target 82 to generate the x-rays 96.

In step 184, the x-rays 96 are directed through the window 102, which increases temperature of the window 102. The back-scattered electrons 98 also impinge upon the window 102 and further increase temperature of the window 102.

In step 186, the coolant 130 is passed through multiple thermal exchange devices, such as the fin pocket 118, the porous body 171, or the porous body 176, and is directed at the reflection surface 146, as to impinge on and cool the window 102.

In step 188, the additional coolant 170 may be directed across the window 102, via the second cooling circuit 166.

The above-described steps are meant to be an illustrative example; the steps may be performed synchronously or in a different order depending upon the application.

Figure 10:
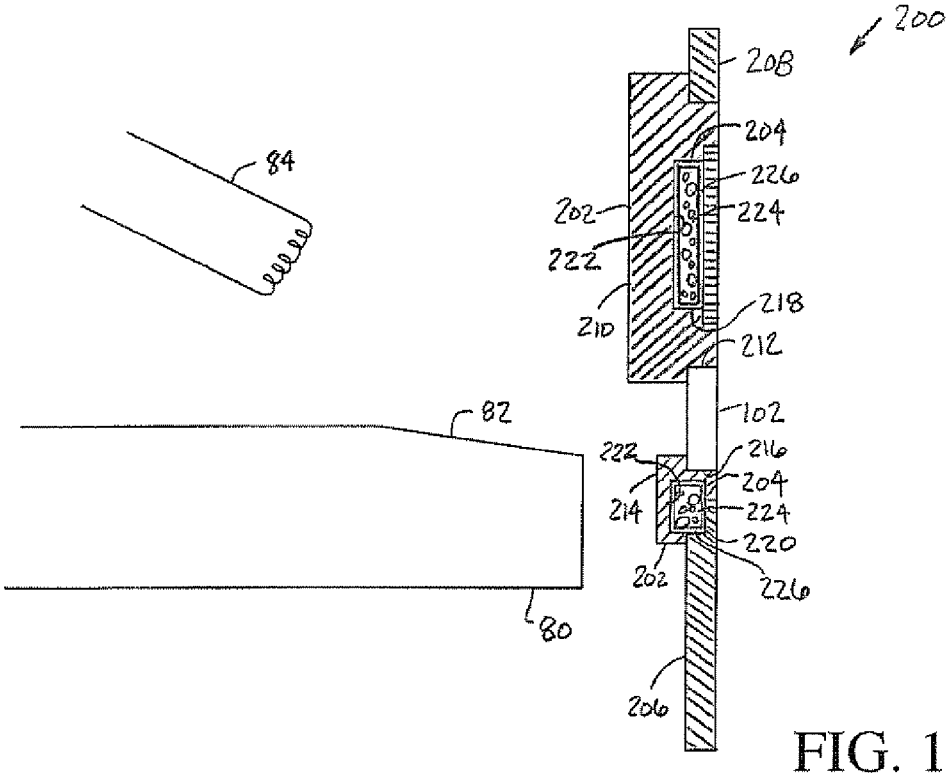
FIG. 10 is a cross-sectional view of an x-ray tube window cooling assembly incorporating multiple thermal receptors and thermal cavities in accordance with another embodiment of the present invention.

Referring now to FIG. 10, a cross-sectional view of an x-ray tube window cooling assembly 200 incorporating multiple thermal receptors 202 and thermal cavities 204 in accordance with another embodiment of the present invention is shown. The thermal receptors 202 are on a vacuum side 206 of an x-ray tube vessel or electron collector body 208.

A first thermal receptor 210 is located on a first side 212 of the x-ray tube window 102 and a second thermal receptor 214 is located on a second side 216 of the window 102. Each of the thermal receptors 202 may receive back-scattered electrons. The first receptor 210 includes a first thermal cavity 218 and the second receptor 214 includes a second thermal cavity 220. The cavities 204 may be coupled to an exterior side 222 of the receptors 202, as shown by the first cavity 218, or may be coupled within the receptors 202, as shown by the second cavity 220.

Although the cavities 204 are shown as containing a porous material 224, they may contain a phase change material, some other similar material, or a combination thereof. A phase change material refers to a material that can store and release large quantities of thermal energy without a significant amount of volume change. The porous material 224 is similar to that mentioned above and may be in the form of a metal alloy, a graphitic material foam, aluminum, a foam, or other similar material. The porous material 224 may be in the form of low density materials, such as a foam. The foam material may be a high thermal conductivity pitch-based graphite, aluminum, copper or a metal alloy.

The cavities 204 may be coupled within or along side of the receptors 202. The cavities 204 may also be coupled directly to the window 102. By direct coupling of the cavities 204 to the window 102, resistance therebetween is reduced. The cavities 204 may have inner liners 226, which may also be formed of a highly conductive metallic material.

Although the thermal receptors 202 are shown as being coupled to the sides of the window 102, the thermal receptors 202 may surround the window 102. Any number of thermal receptors 202 may be utilized. The thermal receptors 202 may be formed of a thermally conductive material, such as copper.

Figure 11:
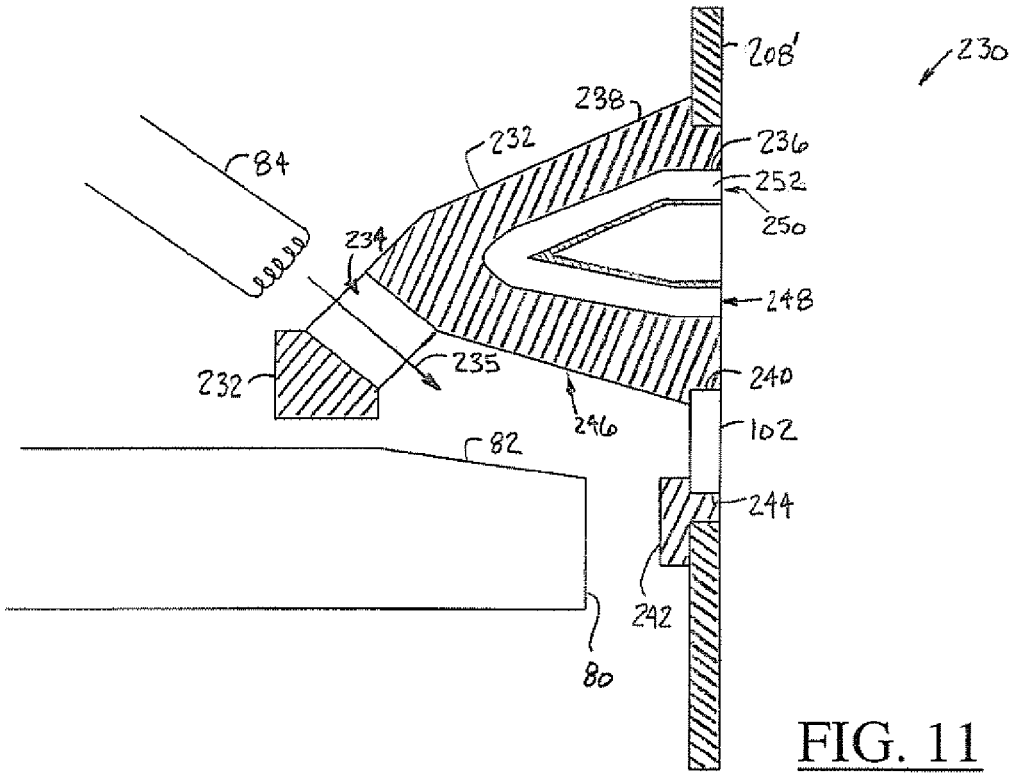
FIG. 11 is a cross-sectional view of an x-ray tube window cooling assembly incorporating a thermal receptor having an electron beam passage and a coolant channel in accordance with another embodiment of the present invention.

Referring now to FIG. 11, a cross-sectional view of an x-ray tube window cooling assembly 230 incorporating a thermal receptor 232 having an electron beam passage 234, for passage of beam 235, and a coolant channel 236 in accordance with another embodiment of the present invention is shown. Similar to the assembly 200, a first thermal receptor 238 is coupled to a first side 240 of the window 102 and a second thermal receptor 242 is coupled to a second side 244 of the window 102. The first thermal receptor 238 has a significantly large surface area 246 and is configured to be over the target 82 and receive a significant amount of back-scattered electrons. The first thermal receptor 238 has the electron beam passage 234 such that back-scattered electrons that are released back towards the cathode 84 or towards the center of the electron collector body 208' are further absorbed by the first thermal receptor 238.

The first thermal receptor 238 is coupled to the coolant channel 236, which absorbs thermal energy within the first thermal receptor 238. The coolant channel 236 has an inlet 248 and an outlet 250. The coolant 252 passing through the coolant channel 236 or any other coolant channel within this specification may be in the form of a high velocity coolant, such as water or a dielectric liquid.

Figure 12:
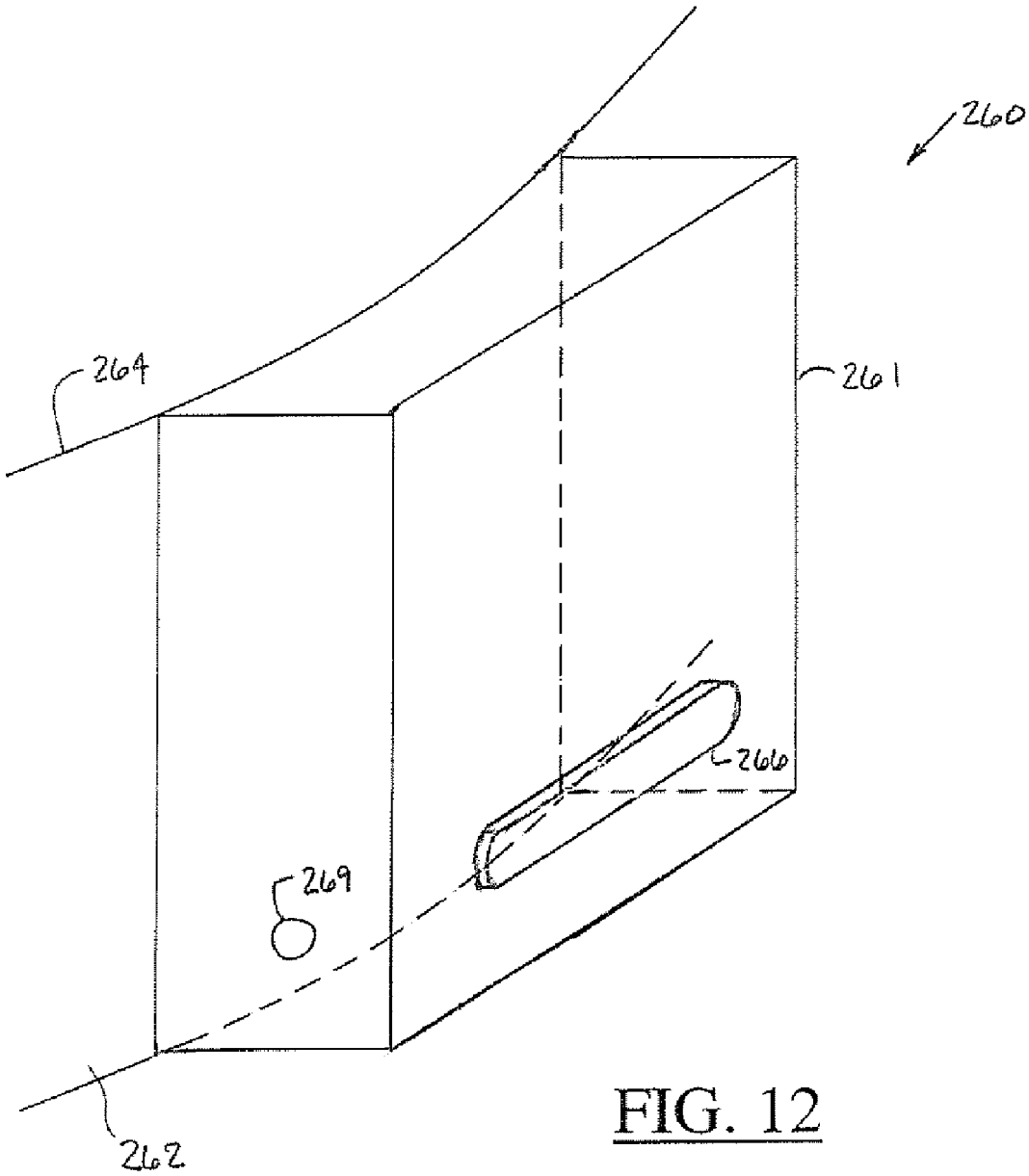
FIG. 12 is a perspective view of an x-ray tube window cooling assembly incorporating a thermal receptor coupled to an exterior sidewall of an electron collector body in accordance with another embodiment of the present invention.
Figure 13:
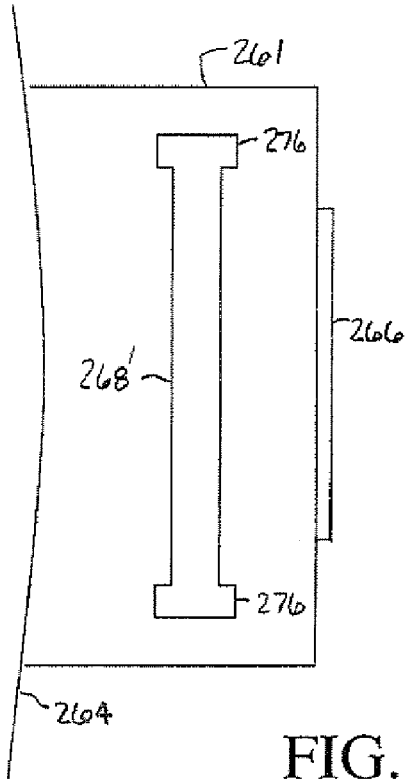
FIG. 13 is a top view of an x-ray tube window cooling assembly incorporating a thermal receptor exterior to an electron collector body having straight coolant channels in accordance with another embodiment of the present invention.
Figure 14:
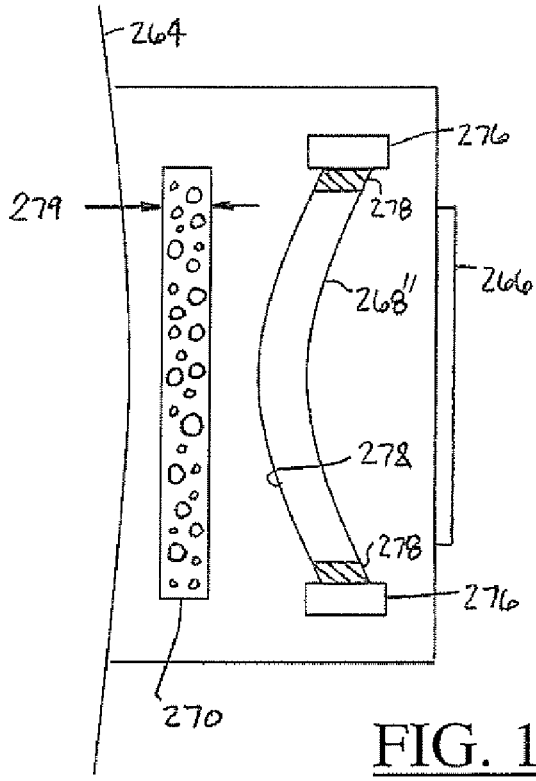
FIG. 14 is a top view of an x-ray tube window cooling assembly incorporating a thermal receptor exterior to an electron collector body having curved coolant channels and a thermal exchange cavity in accordance with another embodiment of the present invention.
Figure 15:
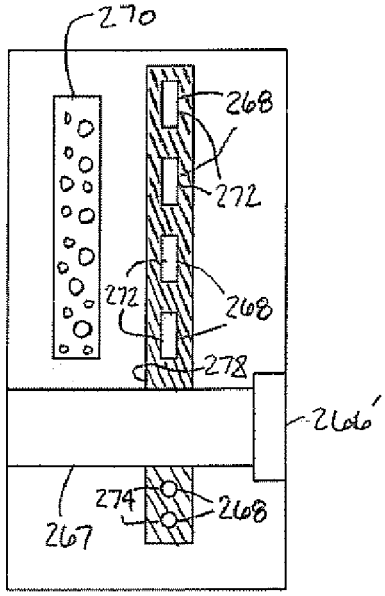
FIG. 15 is a first cross-sectional side view of the x-ray tube window cooling assembly of FIG. 14 in accordance with an embodiment of the present invention.
Figure 16:
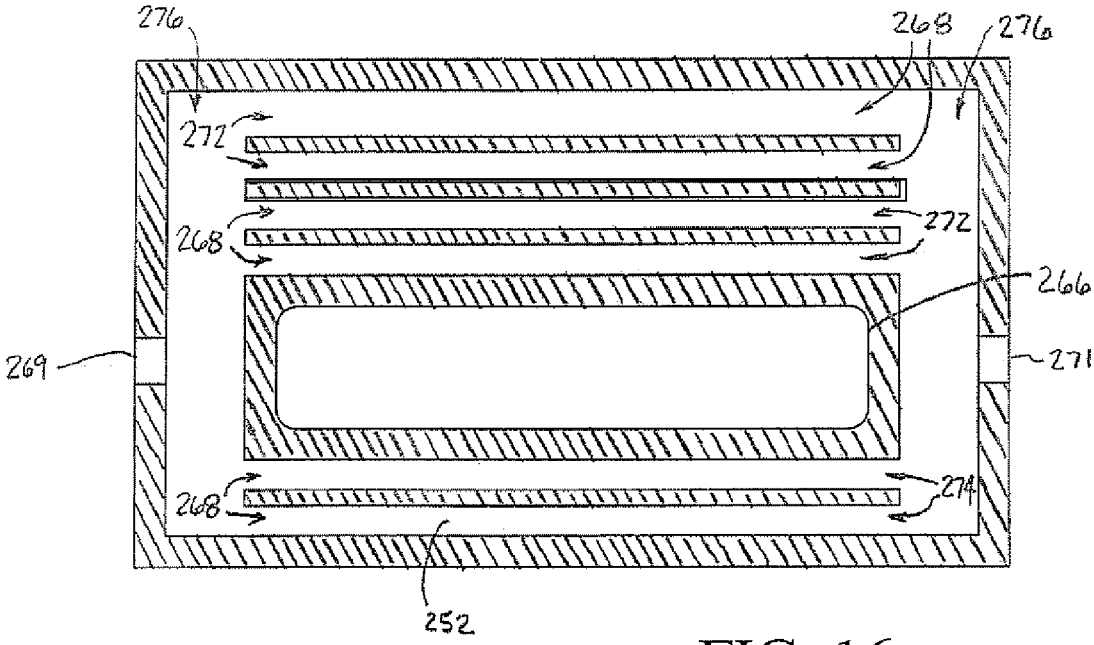
FIG. 16 is a second cross-sectional side view of the x-ray tube window cooling assembly of FIG. 14 in accordance with an embodiment of the present invention.

Referring now to FIGS. 12–16, view of an x-ray tube window cooling assembly 260 incorporating a thermal receptor 261 that is coupled to an exterior sidewall 262 of an electron collector body 264 in accordance with multiple embodiments of the present invention are shown. Although the receptor 261 is shown as being coupled to an electron collector body 264, it may be coupled to an x-ray tube frame or housing or a combination thereof. The receptor 261 includes an x-ray tube window 266, coolant channels 268, as shown in FIGS. 15 and 16, and may include a thermal cavity 270, as shown in FIG. 14. The window 266 may be coupled to the receptor 261, as shown in FIGS. 12–14, or may be coupled within the receptor 261, as shown in FIG. 15 and as designated by 266'. Coolant 252 is pumped through the coolant channels 268 at high flow rates and at high pressures to increase cooling of the collector body 264. There are two cooling mechanisms that occur within the channels 268, namely forced convection and nucleate boiling.

The thermal receptor 261 may be in the form of a thermal heat sink. The thermal receptor 261 may be formed of a lightweight highly thermal conductive material, such as copper. The thermal receptor 261 may also be formed of a low density material or of a phase change material. The thermal receptor 261 is compact in design and provides a substantial amount of cooling. The window 266 may be coupled to the thermal receptor 261 using brazing or other joining method known in the art. The thermal receptor 261 includes an electron beam passage 267, as shown in FIG. 15. The thermal receptor also includes a coolant inlet 269 and a coolant outlet 271, as best seen in FIG. 16.

The coolant channels 268 may be straight or curved as shown in FIGS. 13 and 14 and as designated by 268' and 268". The coolant channels 268, when curved, may be in a streamwise concave configuration, as shown by coolant channels 268", or may be in some other curved configuration to allow an increase in centrifugal acceleration of the coolant 252 passing therethrough. The increase in centrifugal acceleration of the coolant enhances nucleate bubble migration away from the electron collector body 264 and consequently increases power dissipation. The increase in centrifugal acceleration also minimizes coolant pumping requirements.

The coolant channels 268 include a first set of coolant channels 272 and a second set of coolant channels 274 located above and below the window 266, respectively, as shown in FIGS. 15 and 16. The sets in combination provide symmetric cooling of the window 266. The coolant channels 268 may be of various size and shape and be in various configurations. In one embodiment of the present invention, the coolant channels 268 have a circular cross section with a diameter less than or approximately equal to 3 mm.

The coolant channels 268 may have multiple plenums 276 with tapered fins 278, as shown in FIG. 14. The plenums 276 are uniformly divided by the fins 278. The fins 278 are in contact with the walls of the thermal receptor 261 and assure parallel flow of the coolant 252.

The thermal cavity 270 may replace the coolant channels 268 or may be used in addition to the coolant channels 268, as shown in FIGS. 14 and 15. The thermal cavity 270 is able to absorb a large amount of energy and significantly reduce temperatures of the electron collector body 264. The thermal cavity 270 may also contain a porous material, a phase change material, a carbon based material, aluminum, another highly thermally conductive material, or a combination thereof. In one embodiment, the thermal cavity 270 is filled with a porous media or foam and embedded with a phase change material. The thermal cavity 270 may be attached to the thermal receptor 261 using brazing or other known attachment technique. In another embodiment of the present invention, the thermal cavity 270 has a width 279 that is approximately 3.5–6 mm. The thermal cavity 270 may be in various locations within the thermal receptor 261. In another example embodiment, the thermal cavity 270 is located on the vacuum side 278 of the coolant channels 268. The thermal cavity 270 may also include an inner liner (not shown), similar to the liners 226.

For the above stated embodiments that utilize a porous material, the material may have various and varying degrees of porosity. Also, for the embodiments that utilize a phase change material, it may be desirable for the phase change material to have a phase change temperature that is approximately equal to the operational temperature of the vacuum sidewall, such as inner side 113 of the electron collector body 110.

The present invention provides an x-ray generating device window cooling system having multiple thermal exchange devices and configurations for improved cooling. The embodiments of the present invention include thermal receptors, coolant channels, thermal cavities, and other thermal exchange devices that may be formed of or filled with various highly thermal conductive materials. The stated embodiments in so providing significantly increase cooling of an x-ray tube and components therein.

The above-described apparatus and method, to one skilled in the art, is capable of being adapted for various applications and systems known in the art. The above-described invention can also be varied without deviating from the true scope of the invention.

The invention claimed is:

1. An x-ray tube window cooling assembly for an x-ray tube comprising:

at least one electron collector body thermally coupled to an x-ray tube window and comprising;

at least one coolant circuit with a coolant inlet and a coolant outlet; and at least one thermal exchange device coupled to said at least one coolant circuit and reducing temperature of a coolant passing through said at least one thermal exchange device;

wherein said at least one electron collector body has a significantly large surface area that is disposed over and is approximately parallel with a target surface area, and is configured and oriented to receive a significant amount of back-scattered electrons.

2. An x-ray tube window cooling assembly for an x-ray tube comprising:

a first electron collector body and a second electron collector body thermally coupled to an x-ray tube window comprising;

at least one coolant circuit with a coolant inlet and a coolant outlet; and at least one thermal exchange device coupled to said at least one coolant circuit and reducing temperature of a coolant passing through said at least one thermal exchange device;

said first electron collector body and said second electron collector body non- integrally formed with each other.

3. An x-ray tube window cooling assembly for an x-ray tube comprising:

at least one electron collector body thermally coupled to an x-ray tube window and comprising, at least one coolant circuit with a coolant inlet and a coolant outlet; and at least one thermal exchange device coupled to said at least one coolant circuit and reducing temperature of a coolant passing through said at least one thermal exchange device, said at least one thermal exchange device is contained within said at least one electron collector body;

wherein at least a portion of said at least one thermal exchange device is curved.

4. An x-ray tube window cooling assembly for an x-ray tube comprising:

at least one electron collector body thermally coupled to an x-ray tube window and comprising;

at least one coolant circuit with a coolant inlet and a coolant outlet and at least one thermal exchange device coupled to said at least one coolant circuit and reducing temperature of a coolant circulating through said at least one thermal exchange device, at least a portion of said at least one thermal exchange device comprising a finless porous body.

5. An x-ray tube window cooling assembly for an x-ray tube comprising:

at least one electron collector body thermally coupled to an x-ray tube window and comprising;

at least one coolant circuit with a coolant inlet and a coolant outlet;

a cavity; and at least one thermal exchange device coupled to said at least one coolant circuit and reducing temperature of a coolant circulating through said at least one thermal exchange device, said at least one thermal exchange device formed at least partially of a phase change material and substantially filling said cavity.

6. An assembly as in claim 1 wherein said at least one thermal exchange device comprises:

a first thermal exchange device; and a second thermal exchange device residing on a vacuum side of said first thermal exchange device.

7. An assembly as in claim 6 wherein said first thermal exchange device comprises a plurality of coolant channels and said second thermal exchange device comprises a porous material.

8. An x-ray tube window cooling assembly for an x-ray tube comprising at least one electron collector body coupled to an x-ray tube window and comprising a non-fin porous body in which a coolant circulates therethrough.

9. An x-ray tube window cooling assembly for an x-ray tube comprising at least one electron collector body coupled to an x-ray tube window and comprising a cavity at least partially filled with a phase change material body in which a coolant circulates through said material body.

10. An assembly as in any of claims 1–5, 8–9, wherein said at least one electron collector body is formed of a conductive metallic material.

11. An assembly as in any of claims 1–5, 8–9, wherein said at least one electron collector body is formed of copper.

12. An assembly as in any of claims 1, 3–5, 8–9, wherein said at least one electron collector body comprises:

a first electron collector body; and a second electron collector body.

13. An assembly as in claim 12 wherein said first electron collector body is coupled to a first side of said x-ray tube window and said second electron collector body is coupled to a second side of said x-ray tube window.

14. An assembly as in any of claims 1–5, 8–9, wherein said at least one electron collector body is formed at least partially of a phase change material.

15. An assembly as in any of claims 1–5, 8–9, wherein said at least one electron collector body is formed at least partially of a porous material.

16. An assembly as in any of claims 1–3, 8–9, wherein said at least one thermal exchange device is selected from at least one of a porous body, a porous element, a channel, a pocket, a fin pocket, and a cooling fin.

17. An assembly as in any of claims 1–3, 5, 8–9, wherein said at least one thermal exchange device comprises a porous body formed of a material selected from at least one of a metal and a graphitic material.

18. An assembly as in any of claims 1–3, 5, 8–9, wherein at least a portion of said at least one thermal exchange device resides within a cavity of said at least one electron collector body.

19. An assembly as in any of claims 1–5, 8–9, wherein said at least one thermal exchange device comprises at least one plenum.

20. An assembly as in any of claim 19 wherein said at least one plenum is divided uniformly.

21. An assembly as in any of claim 19 wherein said at least one plenum is divided by at least one fin.

22. An assembly as in any of claims 1–5, 8–9, wherein said at least one thermal exchange device have a diameter that is less than or equal to approximately 3 mm.

23. An assembly as in any of claims 1–3, 8–9, wherein said at least one thermal exchange device is formed at least partially of a phase change material and a porous material.

24. An assembly as in any of claims 1–5, 8–9, wherein said at least one thermal exchange device comprises:

a first thermal exchange device; and a second thermal exchange device embedded in said first thermal exchange device.

25. An assembly as in any of claims 1–5, wherein coolant passing through said at least one coolant circuit is a high velocity coolant.

26. An assembly as in claim 25 wherein said high velocity coolant is formed at least partially of a fluid selected from at least one of water and a dielectric liquid.

* * * * *